US005450831A

United States Patent [19]

Fukuoka

[11] Patent Number: 5,450,831

[45] Date of Patent: Sep. 19, 1995

[54] FUEL SUPPLY SYSTEM FOR AN ENGINE

[75] Inventor: Yoshihito Fukuoka, Hamamatsu, Japan

[73] Assignee: Sanshin Koygo Kabushiki Kaisha, Hamamatsu, Japan

[21] Appl. No.: 302,333

[22] Filed: Sep. 8, 1994

[30] Foreign Application Priority Data

Sep. 8, 1993 [JP] Japan ..... 5-223705

[51] Int. Cl.[6] ..... F02M 37/20; F02B 37/04

[52] U.S. Cl. ..... 123/509; 123/516; 123/580

[58] Field of Search ..... 123/509, 516, 495, 579, 123/580

[56] References Cited

U.S. PATENT DOCUMENTS

| | | | |
|---|---|---|---|
| 4,653,762 | 3/1987 | Nakamura et al. | 123/495 |
| 4,811,717 | 3/1989 | Nakahama | 123/495 |
| 5,018,503 | 5/1991 | Hoshiba et al. | 123/580 |
| 5,036,805 | 8/1991 | Yamamoto et al. | 123/579 |
| 5,036,822 | 8/1991 | Kojima | 123/509 |
| 5,326,293 | 7/1994 | Shishido et al. | 123/580 |
| 5,367,998 | 11/1994 | Shiohara et al. | 123/580 |
| 5,375,578 | 12/1994 | Kato et al. | 123/516 |

FOREIGN PATENT DOCUMENTS 3119562 12/1991 Japan .

*Primary Examiner*—Thomas N. Moulis

*Attorney, Agent, or Firm*—Knobbe, Martens, Olson & Bear

[57] ABSTRACT

A fuel delivery system for an engine having multiple, vertically spaced charge formers, and the system is provided with a fuel conduit arrangement so that the individual conduits serving the individual charge formers are kept relatively short in length, but the conduits are interconnected in such a way that any vapor which may form in the conduits will flow vertically upwardly for purging from the system.

16 Claims, 4 Drawing Sheets

FUEL SUPPLY SYSTEM FOR AN ENGINE

BACKGROUND OF THE INVENTION

This invention relates to a fuel supply system for an engine, and more particularly to an improved fuel supply system for an engine having multiple charge formers.

In many applications for internal combustion engines, the engine is provided with a plurality of charge formers. With such an arrangement, it is desirable to ensure that fuel is delivered uniformly and equally to all of the charge formers by the fuel supply system. Although this is generally not a problem, with certain types of applications for internal combustion engines, it can become a problem.

For example, with some applications for internal combustion engines, the charge formers are disposed so that they are positioned vertically above each other. This is typical, for example, in outboard motor practice. In outboard motors, the engine is disposed so that its output shaft rotates about a vertically extending axis. As a result, the individual cylinders extend generally horizontally and are disposed in vertically spaced relationship. The carburetors or other charge formers, therefore, adopt a similar attitude and disposition.

The problem with vertical positioning of the charge formers is that in the fuel delivery system, which frequently includes a single conduit or manifold that extends from the fuel pump to all charge formers, the conduit may be configured in such a way that it forms areas where fuel or vapor may become trapped. This vapor trappage is a problem due to the possibility of heat causing vaporization of the fuel in the fuel manifold. If a fuel vapor pocket forms, then the charge formers downstream of the vapor pocket will not receive fuel, and obvious problems can result.

In order to attempt to alleviate these problems, it has been proposed so as to provide the fuel pump at a lower location than the charge formers. In order to further reduce the likelihood of vapor blockage, the fuel pump may be provided with a plurality of fuel outlets and conduits that feed respective carburetors of the system. With this type of arrangement, however, the fuel pump is normally positioned below the lowest carburetor, and this results in a restriction in the ability of the fuel pump to deliver fuel due to the relatively high head between the fuel pump and the highest carburetor. Also vapor venting is not assured.

It is, therefore, a principal object of this invention to provide an improved fuel supply system for an engine.

It is a further object of this invention to provide an improved fuel supply system for an engine having vertically spaced charge formers.

It is a still further object of this invention to provide an improved fuel supply system for an engine having vertically spaced charge formers and wherein the system will ensure against vapor blockage and further will permit shorter fuel supply lines.

SUMMARY OF THE INVENTION

This invention is adapted to be embodied in a fuel supply system for supplying fuel to a multitude of charge formers, each vertically positioned vertically above the others. A fuel pump is provided for pumping fuel and which has a pair of discharge openings. One of the discharge openings is positioned lower than the uppermost charge former and the other discharge opening is positioned higher than the lowermost charge former. A first fuel pipe extends from the first discharge opening to at least one of the charge formers. A second fuel pipe extends from the other of the discharge openings to at least another of the charge formers. An interconnecting fuel pipe interconnects the charge formers with each other through the discharge pipes. At least one of the discharge conduits extends in a vertically upward direction for permitting vapor accumulating in the system to move to the uppermost charge former.

DETAILED DESCRIPTION OF THE PREFERRED EMBODIMENT OF THE INVENTION

Figure 1:
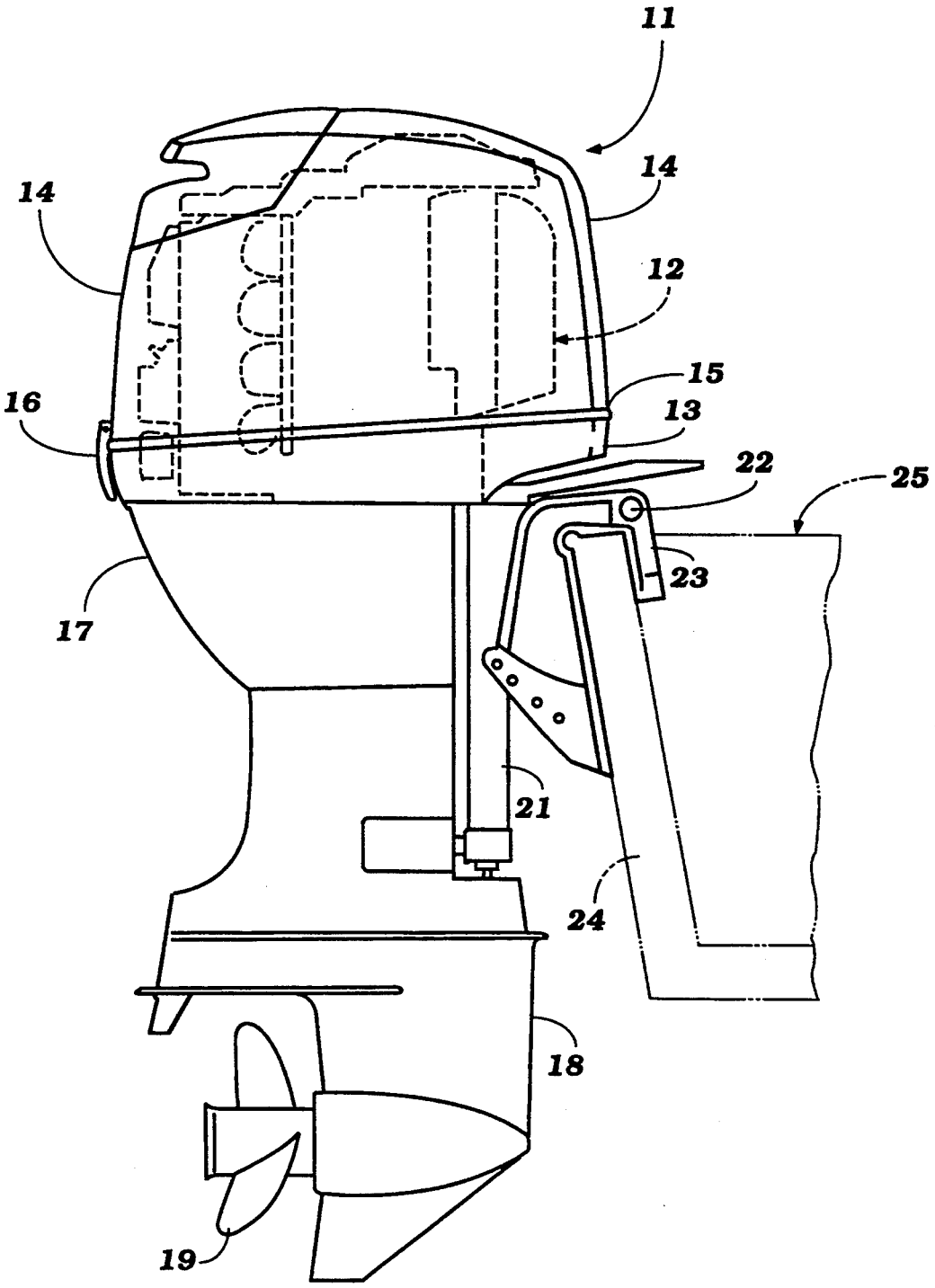
FIG. 1 is a side elevational view of an outboard motor constructed in accordance with an embodiment of the invention and attached to the transom of an associated watercraft, shown partially and in phantom.

Referring now in detail to the drawings and initially primarily to FIG. 1, an outboard motor constructed in accordance with an embodiment of the invention is identified generally by the reference numeral 11. The invention is described as embodied in an outboard motor because outboard motors frequently are positioned so that their charge formers are disposed vertically relative to each other. The invention has particular utility in a fuel system for supplying such charge formers. Of course, it will be readily apparent to those skilled in the art that the invention may be employed in conjunction with other applications for engines having such charge former disposition.

The outboard motor 11 is comprised of a power head that consists of a powering internal combustion engine, indicated generally by the reference numeral 12, and a surrounding protective cowling that is comprised of a lower tray portion 13 and an upper, main cowling portion 14. The tray portion 13 and main cowling portion 14 are connected to each other by means of a hinge 15 at one end thereof and are held in their closed positions by means of a latch assembly 16 disposed at the other end thereof. Of course, other forms of arrangements for enclosing the engine 12 and permitting its accessing for service as are well known in this art may be employed.

A drive shaft housing 17 depends from the power head and contains a drive shaft (not shown) that is drivingly coupled to the output shaft of the engine 12 in a well-known manner. As is typical with outboard motor practice and to accommodate the vertically disposed drive shaft, the engine 12 is supported so that its output shaft rotates about a vertically extending axis. The drive shaft aforereferred to depends into a lower unit 18 where it drives a conventional forward/neutral/reverse transmission (not shown) for driving a propulsion device such as a propeller 19 in selected forward and reverse directions.

A steering shaft, which does not appear in the drawings, is affixed to the drive shaft housing 17 and is journaled for steering movement about a generally vertically extending steering axis within a swivel bracket 21. The swivel bracket 21 is, in turn, connected by means of a pivot pin 22 to a clamping bracket 23. This pivotal connection affords tilt and trim movement of the outboard motor 11, as is also well known in this art. The clamping bracket 23 includes a clamping device or other attachment mechanism (not shown) so as to afford attachment of the outboard motor 11 to a transom 24 of an associated watercraft 25, which is shown only partially and in phantom.

The construction as thus far described may be considered to be conventional, and since the invention deals primarily with the engine 12 and the fuel supply system therefor, further description of the conventional aspects of the outboard motor 11 is not believed to be necessary to enable those skilled in the art to practice the invention. Where any details of the outboard motor 11 or, for that matter, the engine 12 are not described or illustrated, they may be considered to be conventional.

Figure 2:
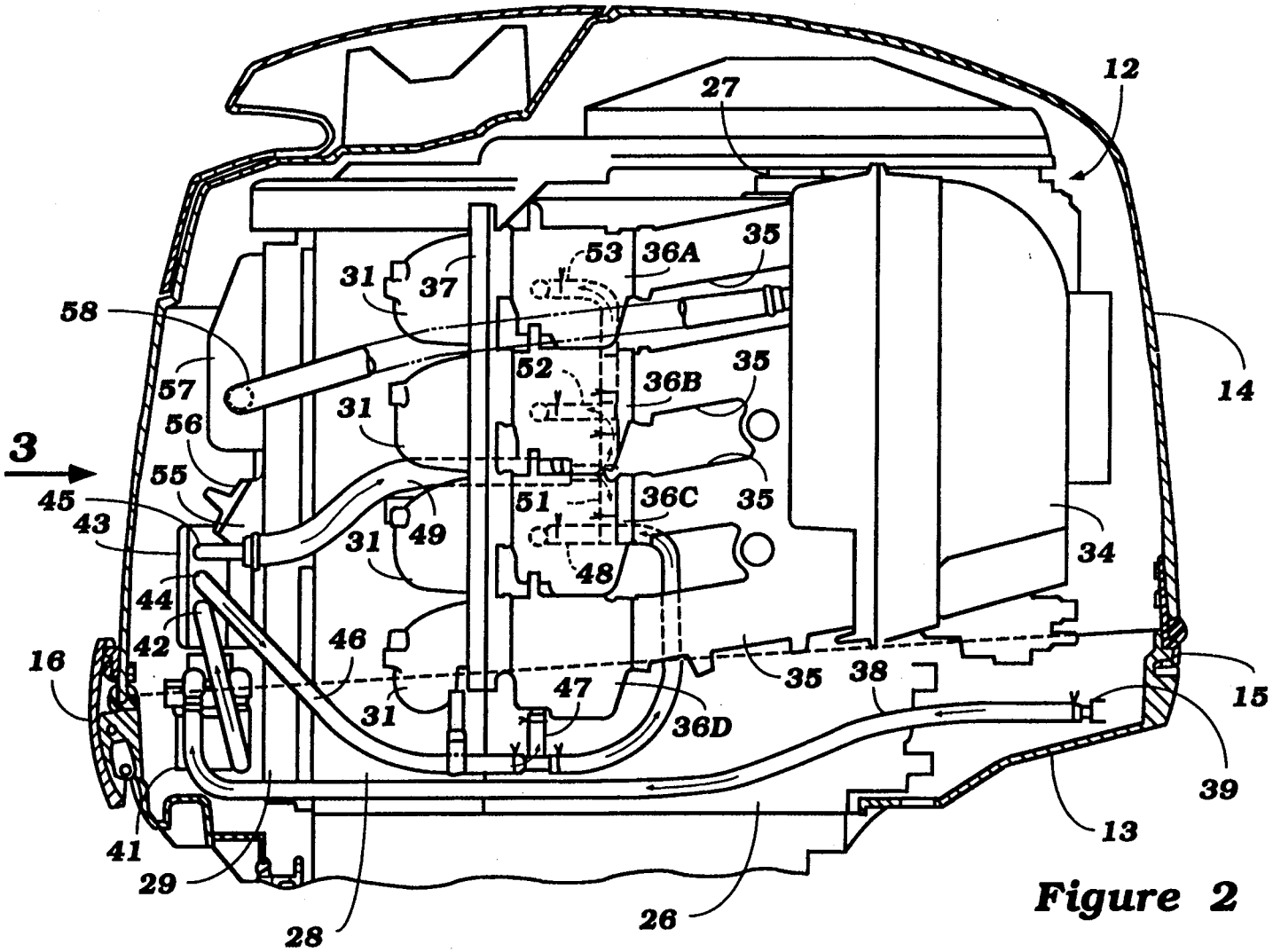
FIG. 2 is a side elevational view of the power head of the outboard motor, shown on a larger scale and with the protective cowling broken away so as to more clearly show the construction.

Referring now primarily to the remaining figures (FIGS. 2–4), the engines 12 is, in the illustrated embodiment, of the four-cylinder, in-line type and operates on a four-stroke principle. It will be readily apparent to those skilled in the art that the invention may be employed with engines having other numbers of cylinders and other cylinder configurations or, for that matter, rotary-type engines. However, the invention does have particular utility wherein the combustion chambers are spaced vertically relative to each other. The engine 12 accomplishes this by providing a cylinder block 26 that has a plurality of cylinder bores that have their axes lying on different horizontal planes and all of which are contained in a common vertical plane. The cylinder block 26 and an associated crankcase member journals the engine output shaft 27 which, as has been noted, rotates about a vertically extending axis. This rotational support is achieved in any known manner. Also, as is well known in the art, the output shaft 27 is driven by connections to pistons reciprocating in the cylinder bores by connecting rods or the like.

A cylinder head assembly 28 is affixed to one end of the cylinder block 26 and closes its cylinder bores. In the illustrated embodiment, the engine 12 is of the overhead camshaft type and includes overhead valves that are operated by a camshaft that is positioned within a cam chamber formed by a cam cover 29 that is affixed to the cylinder head 28 in a known manner. Since the invention deals primarily with the induction system for the engine, it is not believed necessary to discuss or describe the particular valve mechanism. However, it should be noted that the cylinder head 28 is provided with an integral intake manifold 31 which is comprised of individual runners 31A, 31B, 31C, and 31D that communicate with the individual combustion chambers of the engine through the intake valve system.

The intake manifold 31 terminates in a flange portion 32 that extends generally parallel and in the same plane as the sealing surface of the cylinder head 28, which engages the cylinder block 26. An induction system, indicated generally by the reference numeral 33, supplies a charge of air and fuel to the intake manifold 31.

The induction system 33 includes an air inlet device 34 having a downwardly facing air inlet which is disposed to the front of the power head of the outboard motor 11 and on one side of the crankcase chamber in which the crankshaft 27 rotates. This air inlet device 34 is designed so as to provide silencing to the intake air charge.

The intake air charge is delivered to a plurality of intake pipes 35 which extend along one side of the cylinder block 26 and which serve individual charge formers in the form of carburetors 36. Each of the carburetors 36 serves a respective cylinder, and these carburetors are designated by the suffixes A, B, C, and D, considering them in a vertical, downwardly extending direction for ease of description. The carburetors 36A, B, C and D may be of any known type and are attached to the individual manifold sections 31 by means that include a common mounting plate assembly 37 so as to deliver the charge to the individual cylinders of the engine.

Although the construction and type of the individual carburetors 36 may be of any known type, each carburetor is provided with a fuel bowl to which fuel is admitted through a float controlled valve so as to maintain a uniform head of fuel therein. As is well known in the carburetion art, these fuel bowls are vented to the intake passage of the carburetor so as to maintain a uniform pressure balance. This venting system is also employed, in accordance with a feature of the invention, so as to purge any air or fuel vapor from the fuel system.

It is to be understood that, although the invention is described in conjunction with a carbureted engine, certain facets of the invention may be employed in conjunction with other types of charge formers, such as fuel injectors or the like. However, the invention does have particular utility with carbureted engines because of the problem that they encounter with respect to vapor forming in the fuel supply system and the way in which the vapor may be purged with the fuel bowl vent systems, as typical with carburetors. Of course, the system can be also employed in conjunction with an arrangement employing fuel injectors and fuel vapor separators similar to the float bowl arrangement of carburetors.

The fuel supply system includes a main fuel conduit 38 which is provided with a quick disconnect coupling at its forward end, shown schematically at 39, in the lower tray 13 for detachable connection to a remote fuel source, as is well known in this art. This main fuel conduit 38 delivers fuel to a fuel filter 41 positioned at the rear of the power head and adjacent the valve cover 29 near the lower end thereof. After the fuel has passed through the fuel filter 41, it is delivered through a supply conduit 42 to an engine-driven fuel pump 43. The fuel pump 43 is operated by the camshaft of the engine through a rocker arm (not shown), and for this purpose, the fuel pump 43 has an actuating plunger 44 (FIG. 4) that extends into the cam chamber through the cam cover 29.

This fuel pump 43 is provided with a pair of discharges comprising a lower discharge 44 and an upper discharge 45. It should be noted that each of the discharges 44 and 45 are positioned vertically above the lowermost carburetor 36D, and specifically its fuel bowl, and below the uppermost carburetor 36A and its fuel bowl. In the illustrated embodiment, the lower fuel discharge 44 is disposed above the lowermost carburetor 36D and below the next highest carburetor 36C. The higher fuel discharge 45 is disposed at approximately the level of the carburetor 36C and below the carburetors 36A and 36B. Because of this positioning, the length which the fuel must travel vertically from the fuel pump 43 to the respective carburetors 36A–36D is short, and in some instances the fuel actually flows downhill rather than uphill.

A first fuel delivery conduit 46 extends from the lower fuel discharge 44 vertically downwardly and has a first branch 47 that extends vertically upwardly and delivers fuel to the fuel bowl of the lower carburetor 36D. The conduit 46 then turns upwardly and has a horizontally extending branch 48 that extends to the fuel bowl of the next higher carburetor 36C.

A fuel delivery conduit 49 extends generally vertically upwardly from the upper fuel discharge 45 and feeds a T-connection to a vertically extending conduit 51. The conduit 51 intersects the conduit 48, and hence, the conduits 46 and 49 communicate with each other. In addition, the vertical conduit 51 has branches 52 and 53 that extend to the fuel bowls of the carburetors 36B and 36A.

Figure 3:
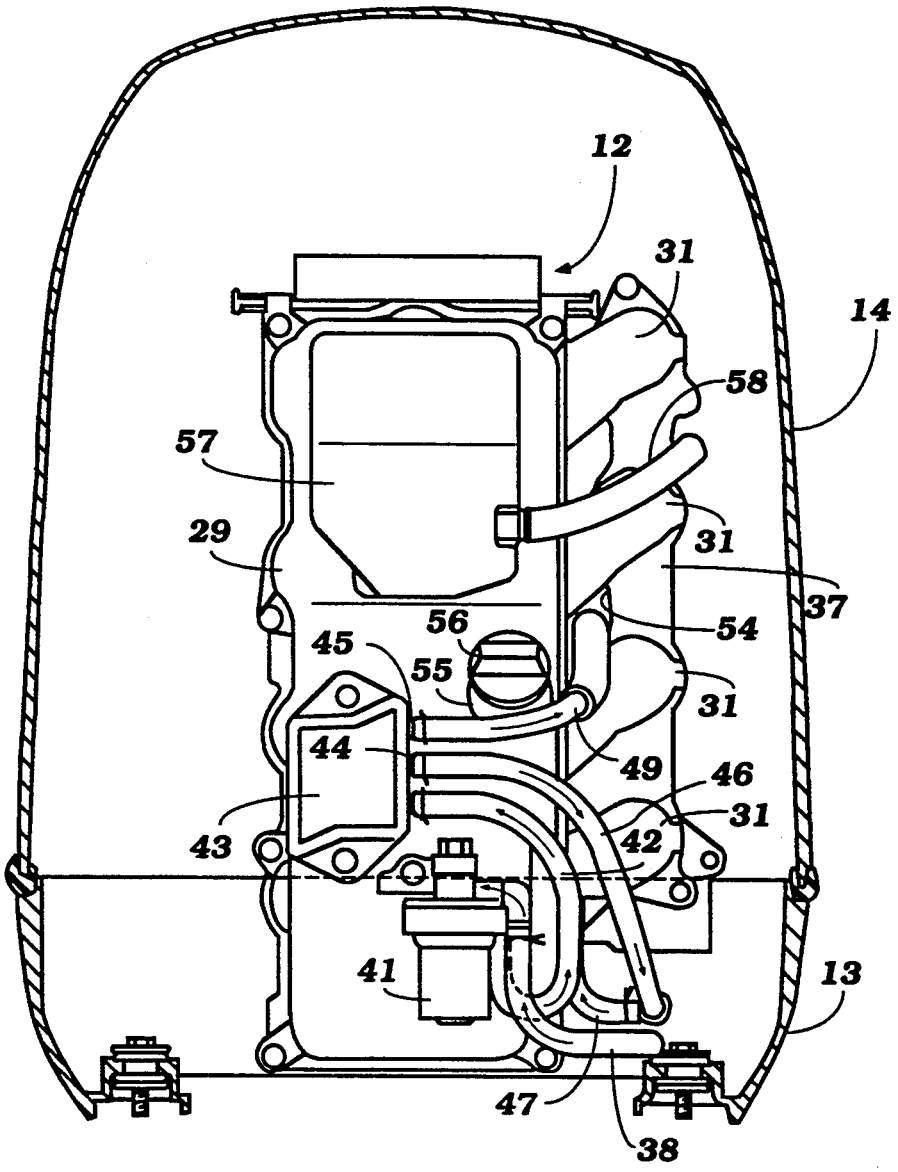
FIG. 3 is a rear elevational view of the portion of the power head looking in the direction of the arrow 3 in FIG. 2 and with the protective cowling broken away.
Figure 4:
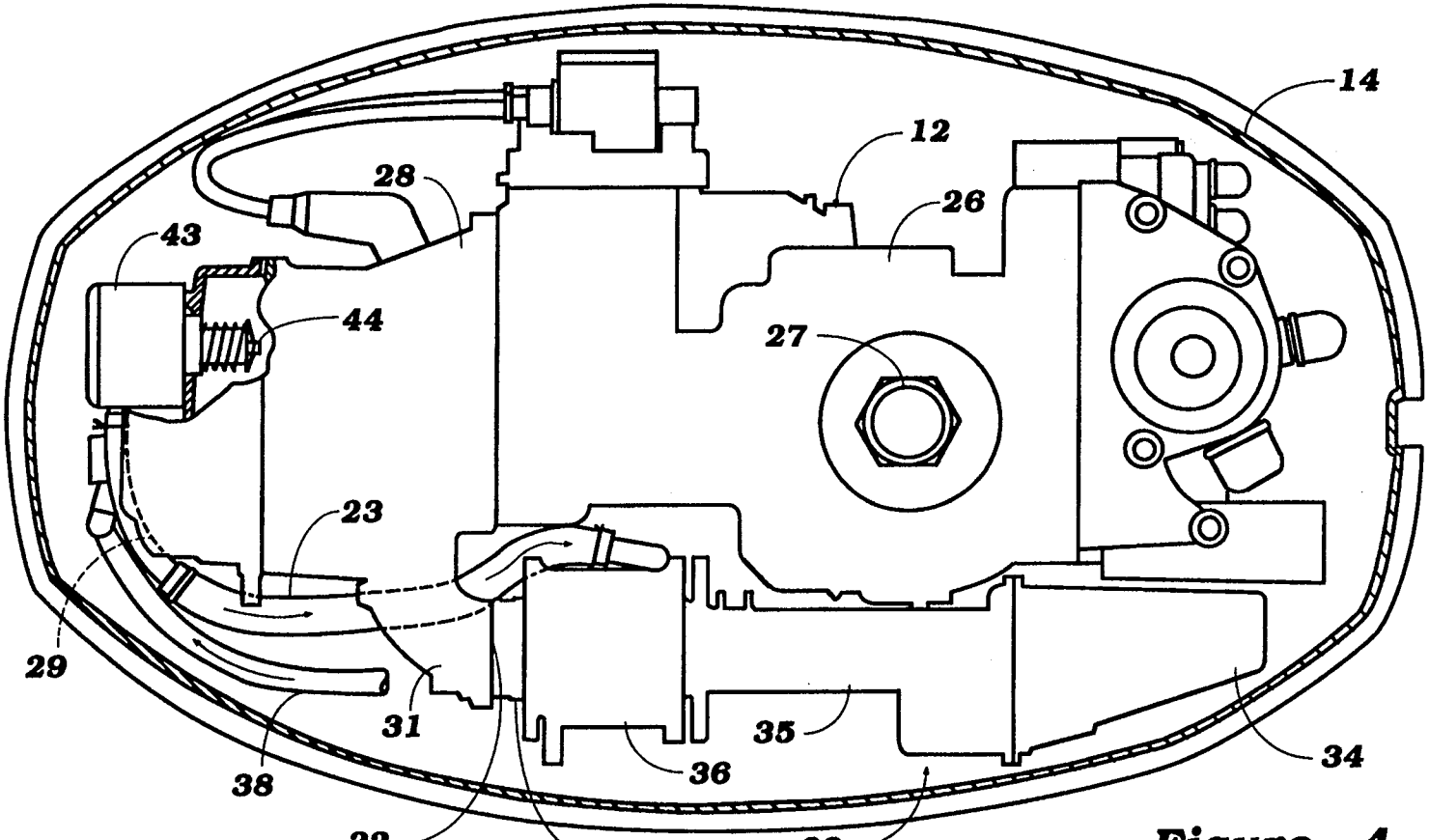
FIG. 4 is a top plan view of the power head with the protective cowling broken away again to more clearly show the construction and also with a portion of the engine broken away and shown in section.

The intermediate portion of the conduit 49 passes through an aperture in the mounting flange 37, which is shown in FIG. 3 and is identified by the reference numeral 54. Hence, it is ensured that the conduit 49 extends generally in a vertically upward direction so that any air or fuel vapor in the system can travel vertically upwardly to the fuel bowl of the uppermost carburetor 36A which will act as a fuel vapor separator, as aforenoted, and purge vapor and air from the system. As a result, even though the conduit 46 has a downwardly extending section, air or vapor cannot be trapped in the conduitry and preclude its delivery to any of the carburetors 36.

The cam cover 29 is provided with a fill neck 55 that has a removable cap 56 so that lubricant may be added to the lubricating system for the engine 12 through the fill neck 55.

In addition, the cam cover 29 is formed with a lubricant vapor separator 57 from which lubricant is separated from the crankcase ventilating gases with this gas flow then being delivered through a conduit 58 to the air inlet device 34 for recirculation through the engine so as to reduce undesirable exhaust emissions.

From the foregoing description, it should be readily apparent that the described construction provides a very effective fuel delivery system and one in which any vapor which may form in the system will be readily purged and cannot interfere with the fuel flow to the carburetors. In addition, by the positioning of the fuel pump below the uppermost carburetor and above the lowermost carburetor, it is possible to keep the delivery lines relatively short and ensure adequate fuel flow to the engine and equal fuel flow to all of the carburetors 36A–36D.

It should be readily apparent that the foregoing description is that of a preferred embodiment of the invention, and that various changes and modifications may be made without departing from the spirit and scope of the invention, as defined by the appended claims.

I claim:

1. A fuel supply system for supplying fuel to a plurality of charge formers disposed in a vertical relation to each other, a fuel pump for pumping fuel, said fuel pump having at least two fuel discharge openings, one of said fuel discharge openings being positioned below the uppermost charge former, the other of said fuel discharge openings being positioned higher than the lowermost charge former, a first conduit extending from said first discharge opening of said fuel pump to one of the uppermost charge formers, a second fuel conduit extending from the lower fuel pump discharge opening to one of the lower charge formers, and an interconnecting conduit interconnecting said first and said second conduits with each other and with each of the charge formers so that any vapor forming in the system can travel vertically upwardly to the uppermost charge former.

2. A fuel supply system as in claim 1, wherein the fuel pump first fuel discharge opening is positioned above the lowermost charge former.

3. A fuel supply system as in claim 1, wherein the second fuel pump fuel discharge opening is positioned below the uppermost charge former.

4. A fuel supply system as in claim 3, wherein the first fuel pump fuel discharge opening is positioned above the lowermost charge former.

5. A fuel supply system as in claim 1, wherein the first fuel conduit terminates at a position vertically above the first fuel pump fuel discharge opening.

6. A fuel supply system as in claim 1, wherein the second fuel conduit terminates at a point vertically above the second fuel pump fuel discharge opening.

7. A fuel supply system as in claim 6, wherein the second fuel conduit serves the lowermost charge former directly.

8. A fuel supply system as in claim 7, wherein the first fuel conduit terminates at a position vertically above the first fuel pump fuel discharge opening.

9. A fuel supply system as in claim 1, wherein at least the uppermost charge former is provided with a fuel bowl, the level of fuel in which is controlled by a float-operated valve.

10. A fuel supply system as in claim 9, wherein each of the charge formers is provided with a fuel bowl, the level of fuel in which is controlled by a float-operated valve.

11. A fuel supply system as in claim 10, wherein all of the charge formers comprise carburetors.

12. A fuel supply system as in claim 11, wherein there are at least four carburetors.

13. A fuel supply system as in claim 1, wherein there are at least four charge formers.

14. A fuel supply system as in claim 13, wherein the second conduit supplies fuel directly to the lowermost two charge formers.

15. A fuel supply system as in claim 13, wherein the first fuel conduit supplies the uppermost two charge formers directly.

16. A fuel supply system as in claim 15, wherein the second conduit supplies fuel directly to the lowermost two charge formers.

* * * * *